US008983110B2

(12) United States Patent
Fujiwara et al.

(10) Patent No.: US 8,983,110 B2
(45) Date of Patent: Mar. 17, 2015

(54) HEADPHONE DEVICE

(71) Applicant: Sony Corporation, Tokyo (JP)

(72) Inventors: Keitaro Fujiwara, Tokyo (JP); Katsunori Murozaki, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 14/184,844

(22) Filed: Feb. 20, 2014

(65) Prior Publication Data

US 2014/0198943 A1 Jul. 17, 2014

Related U.S. Application Data

(63) Continuation of application No. 12/193,158, filed on Aug. 18, 2008, now Pat. No. 8,767,997.

(30) Foreign Application Priority Data

Aug. 23, 2007 (JP) ..... 2007-217450

(51) Int. Cl.
*H04R 25/00* (2006.01)
*H04R 1/10* (2006.01)

(52) U.S. Cl.
CPC ..... *H04R 1/105* (2013.01); *H04R 1/1066* (2013.01)
USPC ..... 381/381

(58) Field of Classification Search
CPC .. H04R 1/1025; H04R 1/1075; H04R 1/1091; H04R 1/083; H04R 2225/63; H04R 2225/021; H04R 2225/55
USPC ..... 381/380–382, 384, 371, 374, 376, 378, 381/379, 328, 329
See application file for complete search history.

(56) References Cited

U.S. PATENT DOCUMENTS

| | | | |
|---|---|---|---|
| 4,020,297 | A | 4/1977 | Brodie |
| 5,677,964 | A | 10/1997 | Sun |
| 5,729,615 | A | 3/1998 | Yang |
| 7,120,268 | B2 | 10/2006 | Murozaki et al. |
| 7,492,917 | B2 | 2/2009 | Ito |
| 7,873,177 | B2 | 1/2011 | Okamura et al. |
| 2004/0032965 | A1 | 2/2004 | Ito |
| 2007/0003095 | A1 | 1/2007 | Slamka et al. |
| 2007/0258613 | A1 | 11/2007 | Wright |

FOREIGN PATENT DOCUMENTS

| | | |
|---|---|---|
| DE | 200 09 731 | 9/2000 |
| DE | 200 14 380 | 2/2001 |
| JP | 49-51220 | 5/1974 |
| JP | 10-200982 | 7/1998 |
| JP | 2003-111180 | 4/2003 |
| JP | 2003-143680 | 5/2003 |

OTHER PUBLICATIONS

Examination Report from European Patent Office Communication Pursuant to article 94(3) EPC (5 pages).
Notification of Reasons for Refusal with English language translation issued by Japanese Patent Office on Dec. 1, 2009, in Japanese Patent Application 2007-217450.

*Primary Examiner* — Hoa B Trinh
(74) *Attorney, Agent, or Firm* — Finnegan, Henderson, Farabow, Garrett & Dunner, L.L.P.

(57) ABSTRACT

A headphone device including a driver unit, and an ear-hook hanger of a loop shape that is integrated with the driver unit and supports an entire circumference of an ear capsule is provided.

17 Claims, 3 Drawing Sheets

HEADPHONE DEVICE

CROSS REFERENCES TO RELATED APPLICATIONS

This is a continuation of application Ser. No. 12/193,158, filed Aug. 18, 2008. U.S. application Ser. No. 12/193,158 claims the benefit of Japanese Patent Application No. 2007-217450, filed Aug. 23, 2007. Each of the above-referenced applications is incorporated herein by reference in its entirety.

BACKGROUND OF THE INVENTION

1. Field of the Invention

The present invention relates to a headphone device, and is suitably applied to an ear-hook type headphone device that is used by being connected to, for example, a portable music player.

2. Description of the Related Art

As shown in FIG. 1, there has heretofore been an ear-hook type headphone device 100 that is worn in such a manner as hooking a hanger section 101 having an arm shape on ear capsules (for example, refer to Jpn. Pat. Appln. Laid-Open Publication No. 2003-143680).

SUMMARY OF THE INVENTION

In the ear-hook type headphone device 100 having the above configuration, the hanger section 101 needs to be hardened so that the hanger section 101 is held firmly on a head. However, in such a case, there has been a problem that hardening the hanger section 101 itself causes a worse feeling of wearing.

In addition, in the ear-hook type headphone device 100 having the above configuration, the hanger section 101 is held by an upper section of ear capsules. Accordingly, there has been a problem that a strong impact from the outside causes bending of the hanger section 101, and in some cases, dropping off of the entire ear-hook type headphone device 100 from ear capsules.

Further, in case the ear-hook type headphone device 100 having the above configuration is used by the user while running, there has been a problem that the hanger section 101 comes off from ear capsules due to swinging of running, and the entire ear-hook type headphone device 100 drops off.

The present invention has been made in view of the above points, and suggests an ear-hook type headphone device excellent in a feeling of wearing and stability when the headphone device is worn, as compared with the conventional headphone device.

In view of the above, according to an aspect of the present invention, there is provided a headphone device that includes a driver unit, and an ear-hook hanger of a loop shape that is integrated with the driver unit and supports an entire circumference of an ear capsule. In this manner, the entire circumference of the ear capsule can be supported by a surface of the ear-hook hanger. Accordingly, stability when the headphone device is worn is further improved, and at the same time, a feeling of fit is also further improved.

According to an aspect of the present invention, there are provided a driver unit, and an ear-hook hanger of a loop shape that is integrated with the driver unit and supports an entire circumference of an ear capsule. In this manner, the entire circumference of the ear capsule can be supported by a surface of the ear-hook hanger. Accordingly, stability when the headphone device is worn is further improved, and at the same time, a feeling of fit is also further improved. In this manner, a headphone device that is more excellent in a feeling of wearing and stability when the headphone device is worn as compared with a conventional one can be realized.

The nature, principle and utility of the invention will become more apparent from the following detailed description when read in conjunction with the accompanying drawings in which like parts are designated by like reference numerals or characters.

DETAILED DESCRIPTION OF THE PREFERRED EMBODIMENTS

Hereinafter, an embodiment of the present invention will be described in detail with respect to the accompanying drawings.

(1) Configuration of Ear-Hook Type Headphone Device

Figure 1:
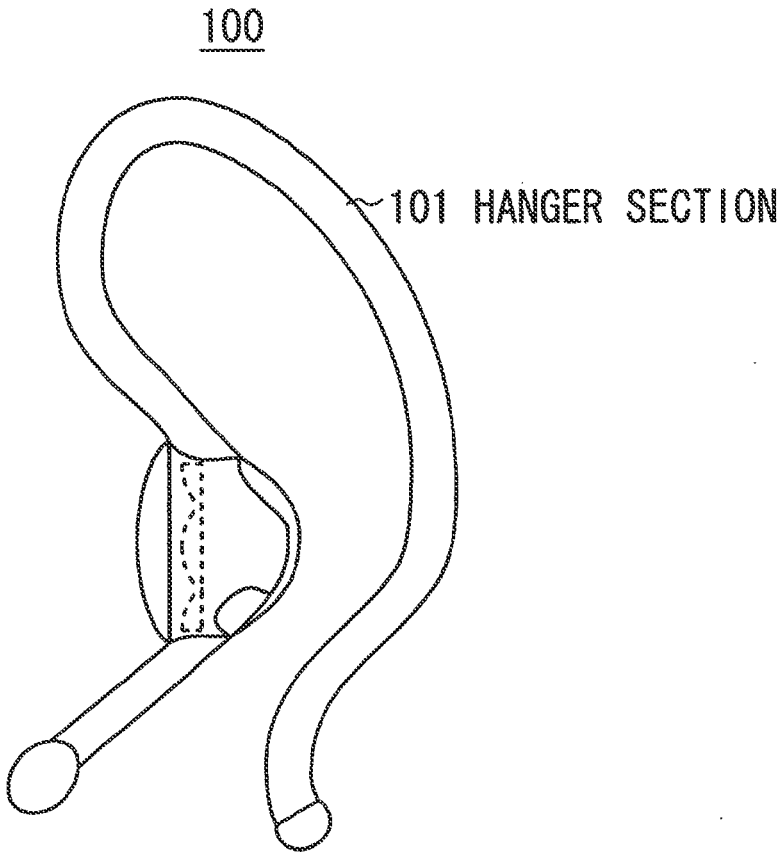
FIG. 1(RELATED ART)
FIG. 1 is a schematic view showing a configuration of a conventional ear-hook type headphone device.
Figure 2A:
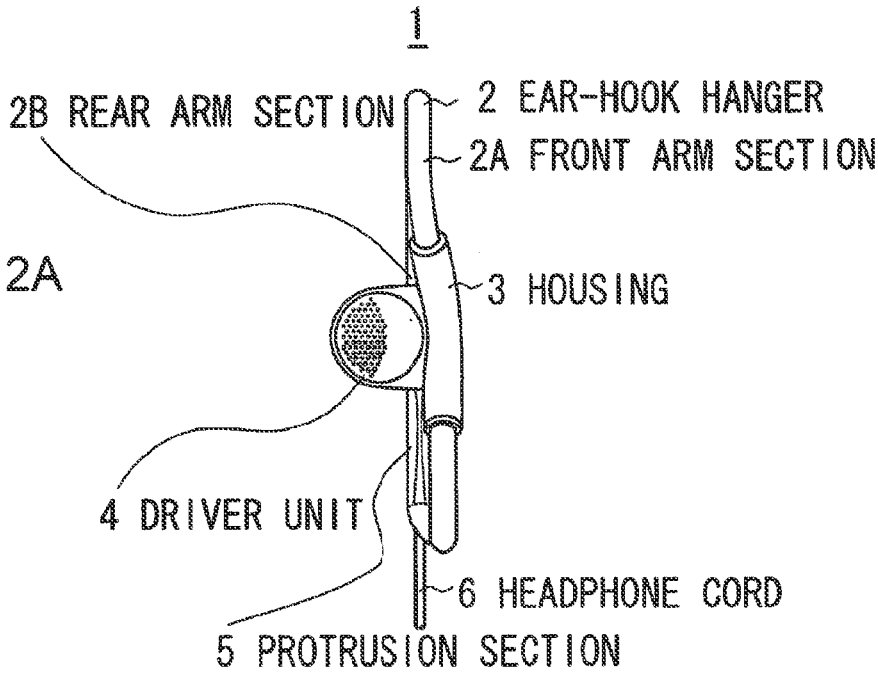
FIG. 2A is a schematic view showing a configuration of an ear-hook type headphone device according to an embodiment of the present invention.
Figure 2B:
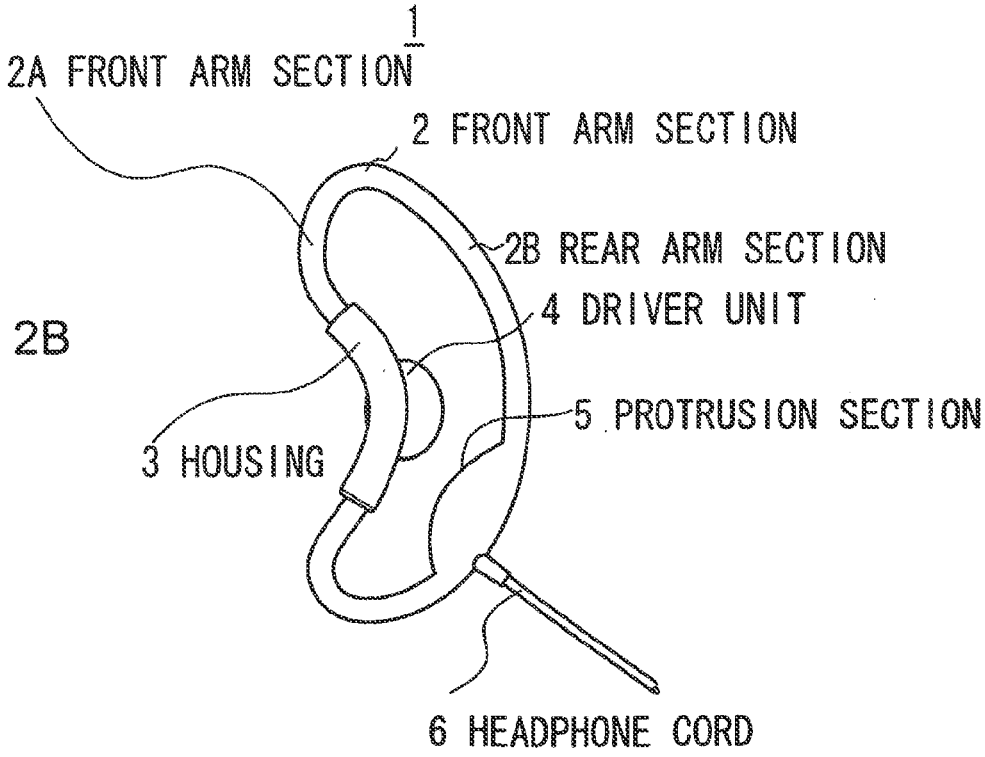
FIG. 2B is another schematic view showing a configuration of an ear-hook type headphone device according to the embodiment of the present invention.

According to Embodiment of Present Invention FIGS. 2A and 2B show an entire ear-hook type headphone device 1 according to an embodiment of the present invention. The ear-hook type headphone device 1 includes an ear-hook hanger 2 and a tubular housing 3. The ear-hook hanger 2 has a loop shape that is curved along an outer shape of an ear capsule of the user. The tubular housing 3 has a substantially reversed C-shape and is formed around a center section of the ear-hook hanger 2.

The housing 3 is provided with a driver unit 4 around a center thereof. The driver unit 4 is allocated so as to face an eardrum when the driver unit 4 is fit into an external acoustic meatus.

The ear-hook hanger 2 is made of an elastic body of synthetic resin, such as polypropylene (PP) and polybutylene terephthalate (PBP). The ear-hook hanger 2 is formed in a curved shape along an outer shape of an ear capsule of a human being, and has a closed annular loop shape as an entire shape.

In addition, the ear-hook hanger 2 (FIG. 2A) includes a rear arm section 2B that is not allocated with the housing 3 in contrast to a front arm section 2A allocated with the housing 3.

The rear arm section 2B is twisted so as to be positioned closer to an ear capsule. In this manner, especially the entire rear arm section 2B contacts a backside base section of an ear capsule when the ear-hook hanger 2 is worn.

That is, when the ear-hook hanger 2 is worn, a surface of the entire rear arm section 2B contacts a backside base section of an ear capsule. In this manner, a feeling of wearing and stability when the headphone is worn can be further improved.

In addition, the ear-hook hanger 2 includes a protrusion section 5 that projects to a lower backside of an ear capsule formed at a lower section of the rear arm section 2B. A headphone cord 6 is attached to the ear-hook hanger 2 through the protrusion section 5.

Figure 3:
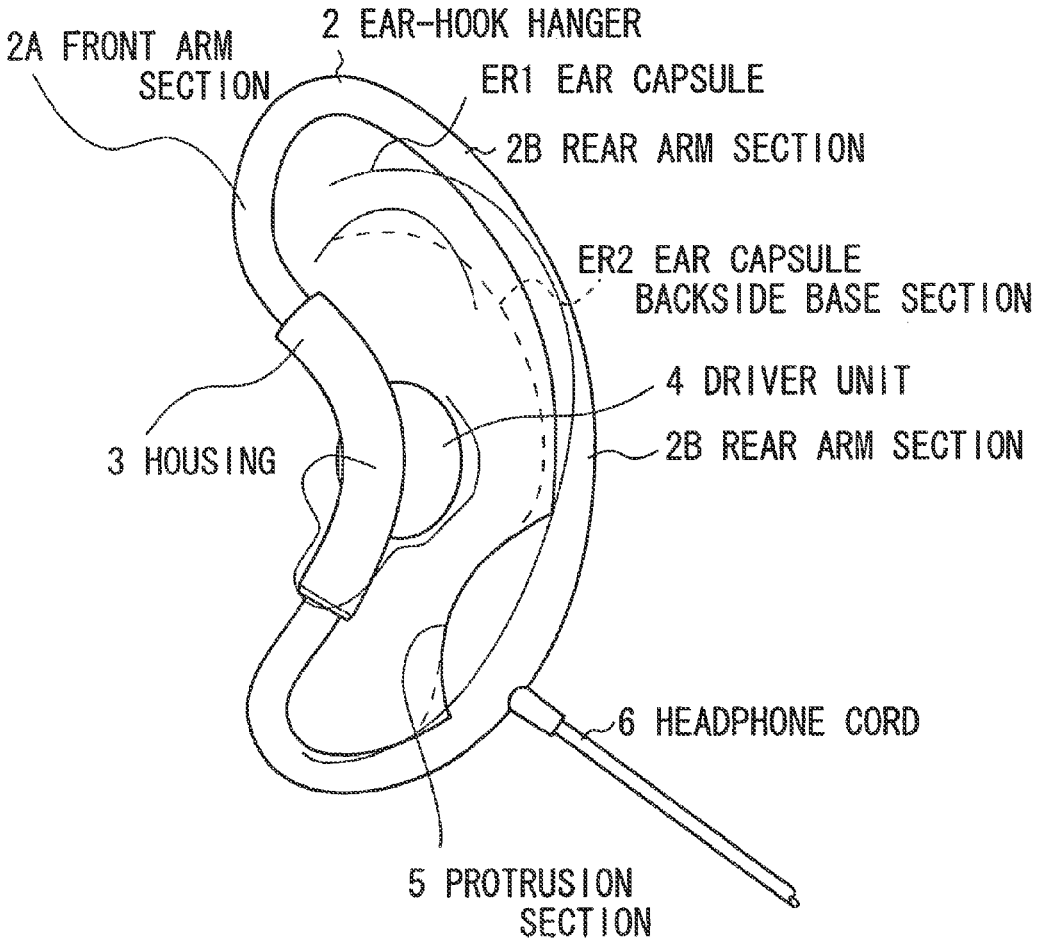
FIG. 3 is a schematic view showing a wearing state an ear-hook type headphone device according to the embodiment of the present invention.

In the above manner, as shown in FIG. 3, when the ear-hook hanger 2 is worn, the surface of the entire rear arm section 2B contacts an ear capsule backside base section ER2 of an ear capsule ER1 so that the ear-hook hanger 2 is held by the ear capsule ER1. At the same time, the protrusion section 5 fits a hollow at the backside of an ear lobe. Accordingly, a feeling of wearing and stability when the headphone is worn can be further improved.

The ear-hook hanger 2 has a knot allocated in an internal space of the protrusion section 5, so as to avoid pulling out of the headphone cord 6. Accordingly, size of the protrusion section 5 is utilized for storage space for the knot, instead of providing space for the knot separately.

(2) Operation and Advantageous Effect

In the structure described above, when the ear-hook type headphone device 1 is actually worn on a head of the user, the ear-hook hanger 2 of a loop shape is put on in a manner hooking on an entire ear capsule, and at the same time, the driver unit 4 fits into an external acoustic meatus.

At this time, the ear-hook type headphone device 1 is firmly held with respect to the entire ear capsule ER1 in such a manner that the driver unit 4 fits into an external acoustic meatus, the surface of the entire rear arm section 2B of the ear-hook hanger 2 contacts the backside base section ER2 of the ear capsule ER1, and at the same time, the protrusion section 5 fits a hollow at the backside of an ear lobe.

In particular, the ear-hook type headphone device 1 has the ear-hook hanger 2 that is formed by an elastic material. Accordingly, individual differences in ear capsules of users are absorbed by such elasticity, and an excellent feeling of wearing can be provided to anyone.

In addition, the ear-hook type headphone device 1 includes the ear-hook hanger 2 having a closed loop shape. Accordingly, even in case a strong impact is applied from the outside, a bending amount of the ear-hook hanger 2 is restricted, and the risk that the ear-hook hanger 2 drops off the ear capsule ER1 can be significantly reduced.

Even when the user uses the ear-hook type headphone device 1 while running, the ear-hook hanger 2 does not come off from an ear capsule due to swinging of running. Accordingly, the entire ear-hook type headphone device 1 does not drop off, allowing the user to continue running comfortably.

Further, the ear-hook type headphone device 1 includes the headphone cord 6 extending in a backward direction from the protrusion section 5 provided on the rear arm section 2B of the ear-hook hanger 2. Accordingly, the user does not feel uncomfortable by the headphone cord 6 hitting a cheek and so on, and an excellent feeling of wearing can be provided.

The ear-hook type headphone device 1 does not require a headband. By using the ear-hook hanger 2, a firm stability when the headphone device is worn that is similar to when a headband is used can be obtained. Accordingly, an excellent feeling of wearing and high stability when the headphone device is worn can be provided with light weight without making the user feel weight of the ear-hook type headphone device 1.

According to the configurations described above, when the ear-hook hanger 2 of a loop shape is mounted in such a manner as hooking the entire ear capsule ER1, the ear-hook type headphone device 1 can be mounted firmly on the ear capsule ER1 by the surface of the entire rear arm section 2B of the ear-hook hanger 2 contacting the ear capsule backside base section ER2 of the ear capsule ER1.

(3) Other Embodiments

In the embodiments described above, the description was made with respect to the case where the driver unit 4 is allocated at the center of the housing provided at a substantial center section of the ear-hook hanger 2. However, the present invention is not limited thereto, and an ear piece of an inner ear type may be allocated in place of the driver unit 4.

In addition, in the embodiments described above, the description was made with respect to the case where the surface of the entire rear arm section 2B of the ear-hook hanger 2 contacts the ear capsule backside base section ER2 of the ear capsule ER1. However, the present invention is not limited thereto, and a surface of the front arm section 2A as well may be actively made, contacting a cheek in front of an ear capsule.

Further, in the embodiments described above, the description was made with respect to the case where the ear-hook hanger 2 is formed by using as a material an elastic body made of synthetic resin, such as polypropylene (PP) and polybutylene terephthalate (PBP). However, the present invention is not limited thereto, and the ear-hook hanger 2 is not necessarily be formed by an elastic body made of synthetic resin, but may as well be formed by using a metallic material having corrosion resistance and a metallic material having elasticity.

Further, in the embodiments described above, the description was made with respect to the case where the ear-hook type headphone device 1 as the headphone device according to the embodiment of the present invention includes the driver unit 4 as a driver unit and the ear-hook hanger 2 as an ear-hook hanger. However, the present invention is not limited thereto, and the headphone device according to the embodiment of the present invention may include driver units and ear-hook hangers having other various kinds of shapes and structures.

The headphone device according to the embodiment of the present invention can be applied to a headphone device that is used by being connected to, for example, a portable phone, a personal digital assistant (PDA), a notebook type personal computer, and other various types of electronic equipment, in addition to a portable type music player.

It should be understood by those skilled in the art that various modifications, combinations, sub-combinations and alterations may occur depending on design requirements and other factors insofar as they are within the scope of the appended claims or the equivalents thereof.

What is claimed is:

1. A headphone comprising:

an ear-hook hanger for hooking on an ear of a user, the ear hook hanger comprising:

a rear arm section including a first upper portion and a first lower portion, the rear arm section being formed to correspond with a shape of the ear of the user when the user wears the headphone;

a protrusion section at the first lower portion, the protrusion projecting to a lower backside of an ear capsule of the ear;

a front arm section including a second upper portion which connects with the first upper portion;

a housing connected to the second upper portion;

a headphone cable extending out from the protrusion section at the first lower portion; and a driver unit housed in the housing.

2. The headphone according to claim 1, wherein the ear-hook hanger is comprised of a material having elasticity.

3. The headphone according to claim 1, wherein the rear arm section is configured to contact a backside base section of the ear capsule when the user wears the headphone.

4. The headphone according to claim 1, wherein the ear-hook hanger has a knot allocated in an internal space of the protrusion section.

5. The headphone according to claim 1, wherein the front arm section is configured to contact a cheek of the user.

6. The headphone according to claim 1, wherein:

the front arm section further includes a second lower portion, the housing is located between the second upper portion and the second lower portion, and the second upper portion and the second lower portion protrude forward relative to the housing and the rear arm section.

7. The headphone according to claim 5, wherein the ear-hook hanger is comprised of a synthetic resin.

8. The headphone according to claim 5, wherein the ear-hook hanger is comprised of a metallic material having corrosion resistance.

9. The headphone according to claim 1, wherein an ear piece of an inner ear type attached to the housing.

10. The headphone according to claim 1, wherein the housing has a substantially reversed C shape.

11. The headphone according to claim 1, wherein the driver is attached to a center of the housing.

12. The headphone according to claim 1, wherein the surface of the rear arm section contacts the ear capsule backside of the ear capsule.

13. The headphone according to claim 1, wherein the housing includes:

a connection part connected to the ear-hook hanger, and a driver housing part for housing the driver unit.

14. The headphone according to claim 1, wherein the ear-hook hanger is a closed annular loop shape.

15. The headphone according to claim 1, wherein signal lines are provided inside of the ear-hook hanger, the signal lines extending to the driver unit from the first lower portion.

16. The headphone according to claim 1, wherein the headphone is used by being connected to a portable type music player.

17. The headphone according to claim 1, wherein the headphone is used by being connected to a portable phone.

* * * * *